US005404891A

United States Patent [19]

Kiribuchi

[11] Patent Number: 5,404,891

[45] Date of Patent: Apr. 11, 1995

[54] AUTOMATICALLY EXTINGUISHABLE CIGARETTE

[75] Inventor: Nobuyoshi Kiribuchi, Gumma, Japan

[73] Assignee: Taijiro Ishikawa, Gumma, Japan

[21] Appl. No.: 219,092

[22] Filed: Mar. 29, 1994

[30] Foreign Application Priority Data

Mar. 31, 1993 [JP] Japan ..... 5-074679

[51] Int. Cl.[6] ..... A24D 3/00; A24D 1/10

[52] U.S. Cl. ..... 131/349; 131/337

[58] Field of Search ..... 131/349, 337, 335, 340–342, 131/3444

[56] References Cited

U.S. PATENT DOCUMENTS

| | | | |
|---|---|---|---|
| 2,547,119 | 4/1951 | Henderson | 131/349 |
| 3,288,145 | 11/1966 | Rosenthal | 131/349 |
| 3,985,143 | 10/1976 | Lappin | 131/349 |
| 4,091,821 | 5/1978 | Scorzo | 131/349 |
| 4,865,056 | 9/1989 | Tamaoki et al. | 131/337 |
| 5,331,981 | 7/1994 | Tamaoki et al. | 131/335 X |

FOREIGN PATENT DOCUMENTS

| | | | |
|---|---|---|---|
| 2308667 | 9/1974 | Germany | 131/349 |

*Primary Examiner*—Jennifer Bahr

*Attorney, Agent, or Firm*—Price, Heneveld, Cooper, DeWitt & Litton

[57] ABSTRACT

An automatically extinguishable cigarette includes: a tobacco section in which tobacco is rolled up; a filter section; and an extinguishing member consisting of a cylindrical member provided between the tobacco section and the filter section and formed of a flame-resistant material. The front and rear openings of the cylindrical member are sealed by members formed of a material which is gas permeable but not water permeable. Further, the cylindrical member contains water or a fibrous material impregnated with water, thereby enabling the cigarette to go out by itself if left unextinguished.

6 Claims, 5 Drawing Sheets

AUTOMATICALLY EXTINGUISHABLE CIGARETTE

BACKGROUND OF THE INVENTION

This invention relates to an improved tobacco and, in particular, to an improved cigarette.

Conventional cigarettes are entirely composed of flammable materials. Once lighted, the tobacco of a cigarette, rolled up in quality paper, does not go out until it is entirely burned up. When an unextinguished cigarette is thrown into an ashtray, the smoldering cigarette will contaminate the air of the room, thereby deteriorating the interior environment and threatening to harm the health of both the smoker and other people in the room.

Further, forest fires are often caused by unextinguished cigarettes carelessly thrown away by a smoker, resulting in great disasters.

In addition, nicotine, tar, etc., inhaled with cigarette smoke, can cause chronic nicotine poisoning of a smoke or lung cancer. To prevent nicotine poisoning or lung cancer, a filter or the like is attached to one end of the cigarette so as to filter the smoke. However, this filter is also made of a flammable substance, so that it does not contribute to preventing a fire caused by an unextinguished cigarette carelessly thrown away, nor does it help to solve the problem concerning health.

SUMMARY OF THE INVENTION

It is an object of this invention to provide an automatically extinguishable cigarette which can prevent a fire caused by an unextinguished cigarette carelessly thrown away.

Another object of this invention is to provide an automatically extinguishable cigarette which goes out by itself without smoldering when it is left unextinguished in an ashtray, thereby substantially reducing the degree of air pollution in the room.

Still another object of this invention is to provide an automatically extinguishable cigarette in which the amount of nicotine and tar inhaled by the smoker is reduced, thereby mitigating the danger of chronic poisoning, lung cancer, etc. due to heavy smoking.

A further object of this invention is to provide an automatically extinguishable cigarette which has an extinguishing member in that section thereof which is usually left unsmoked, i.e., the cigarette section adjoining the section placed in the smoker's mouth, so that the cigarette section which is actually used, i.e., the amount of tobacco used, is reduced, thereby reducing waste. Further, by filtering the tobacco smoke through water or a fibrous material impregnated with water, the amount of nicotine inhaled is reduced, thereby protecting the health of the smoker.

In accordance with the present invention, an extinguishing member is provided between the filter, which constitutes a mouthpiece at one end of a cigarette, and the section of the cigarette containing tobacco, thereby enabling the cigarette to go out by itself upon the cigarette being burned up to the section where the extinguishing member lies.

This extinguishing member, which, as mentioned above, is inserted between the tobacco section and the filter (mouthpiece) of a cigarette, consists of a cylindrical member made of a flame-resistant plastic material or a thin metal sheet of stainless steel or the like. The open ends of this cylindrical member are sealed by members formed of a composite material which is gas permeable but not water permeable and which is composed, for example., of a micro-porous sheet of polytetrafluoroethylene (hereinafter abridged as "PTFE") and polyurethane. The cylindrical member thus sealed contains moistened fibers or water.

It is also possible for the open ends of the cylindrical member, which is formed of the above-mentioned flame-resistant material, to be sealed by thin metal plates having a multitude of pores, instead of being sealed by the above members made of a composite material consisting of a micro-porous sheet of PTFE and polyurethane. In this case, both the front and rear openings, or only the front opening, of the cylindrical member, may be sealed.

Further, an extinguishing material mixed with a granular fire extinguisher agent may be provided in that section of the cigarette which is adjacent to the filter constituting the mouthpiece.

BRIEF DESCRIPTION OF THE DRAWINGS

The accompanying drawings show embodiments of the automatically extinguishable cigarette of this invention.

FIGS. 1 through 4 show a first embodiment of this invention, of which FIG. 1 is a longitudinal sectional view; FIG. 2 is an enlarged sectional view taken along the line II—II of FIG. 1; FIG. 3 is an .enlarged sectional view taken along the line III—III of FIG. 1; and FIG. 4 is an enlarged sectional view taken along the line IV—IV of FIG. 1.

FIGS. 5 through 8 show a second embodiment of this invention, of which FIG. 5 is a longitudinal sectional view; FIG. 6 is an enlarged sectional view taken along the line VI—VI of FIG. 5; FIG. 7 is an enlarged sectional view taken along the line VII—VII of FIG. 5; and FIG. 8 is an enlarged sectional view taken along the line VIII—VIII of FIG. 5.

FIGS. 9 through 12 show a third embodiment of this invention, of which FIG. 9 is a longitudinal sectional view; FIG. 10 is an ,enlarged sectional view taken along the line X—X of FIG. 9; FIG. 11 is an enlarged sectional view taken along the line XI—XI of FIG. 9; and FIG. 12 is an enlarged sectional view taken along the line XII—XII of FIG. 9.

FIGS. 13 through 16 show a fourth embodiment of this invention, of which FIG. 13 is a longitudinal sectional view; FIG. 14 is an enlarged sectional view taken along the line XIV—XIV of FIG. 13; FIG. 15 is an enlarged sectional view taken along the line XV—XV of FIG. 13; and FIG. 16 is an enlarged sectional view taken along the line XVI—XVI of FIG. 13.

DETAILED DESCRIPTION OF THE PREFERRED EMBODIMENTS

Figure 1:
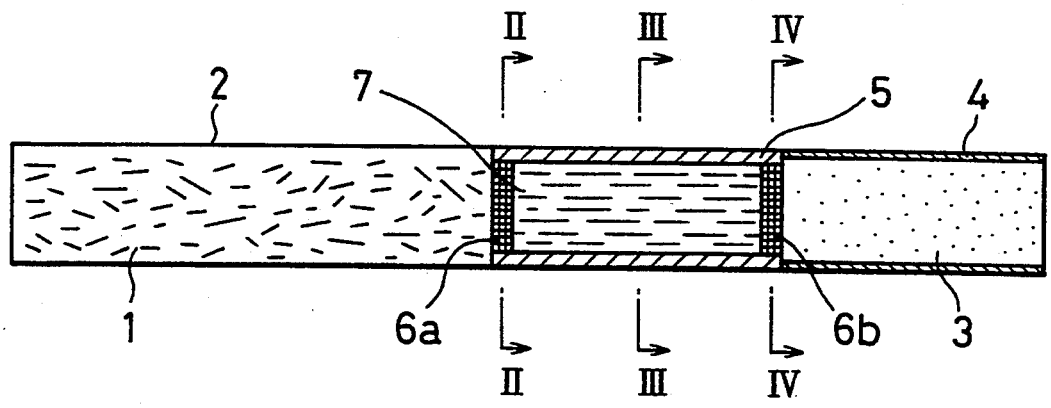
Figure 2:
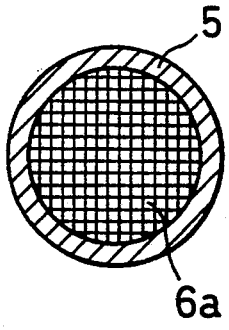
Figure 3:
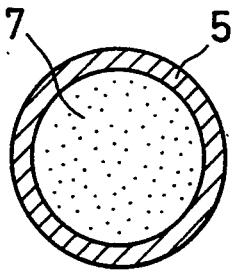
Figure 4:
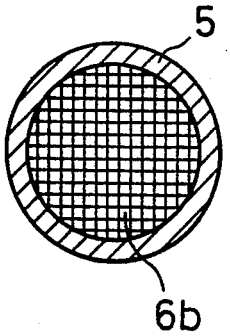

Some embodiments of this invention will be described with reference to the accompanying drawings. In FIGS. 1 through 4, numeral 1 indicates tobacco; numeral 2 indicates a paper in which the tobacco is rolled up; numeral 3 indicates a filter constituting a mouthpiece; and numeral 4 indicates a paper in which the filter 3 is rolled up. In addition to these materials, all of which are among those used in conventional cigarettes, a plastic cylindrical member 5 is provided between the tobacco 1 and the filter 3. Cylindrical member 5 may be made from a flame-resistant plastic material such as a thin sheet of stainless steel, aluminum foil, or the like. The front and rear openings of this plastic cylindrical member 5 are sealed by sealing members 6*a* and 6*b* formed of GORE-TEX (a registered trademark of the U.S. company, W. L. GORE), known as a composite material which is gas permeable but not water permeable and which is composed of a micro-porous sheet of PTFE and polyurethane.

Figure 5:
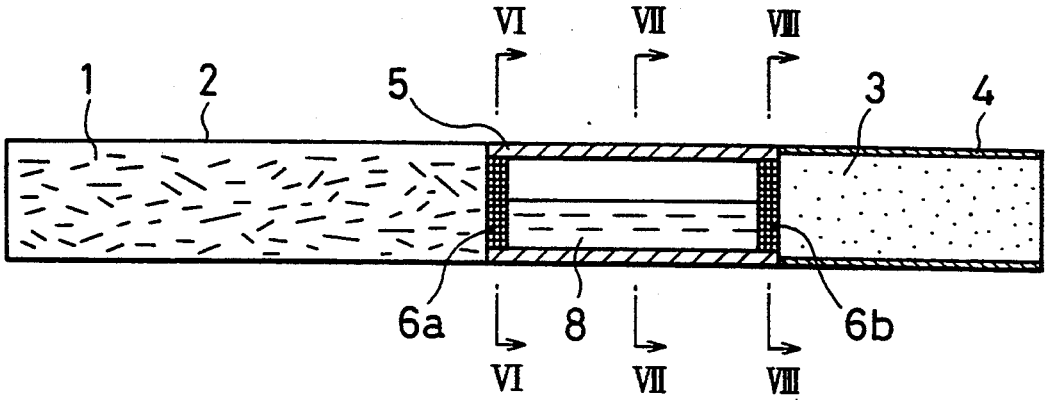
Figure 6:
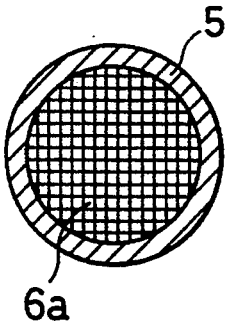
Figure 7:
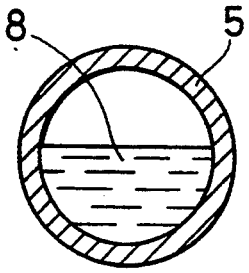
Figure 8:
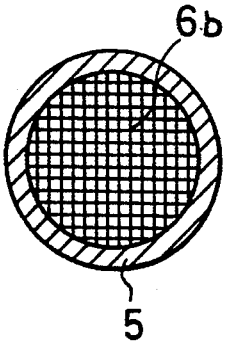
Figure 9:
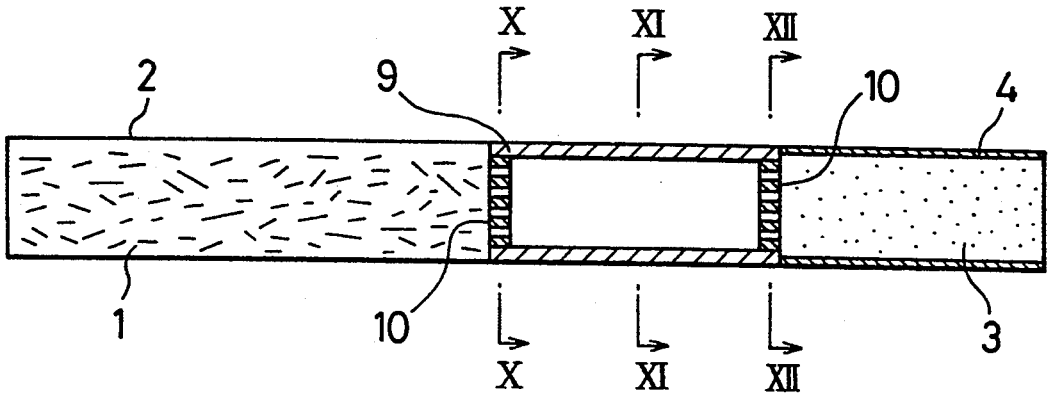
Figure 10:
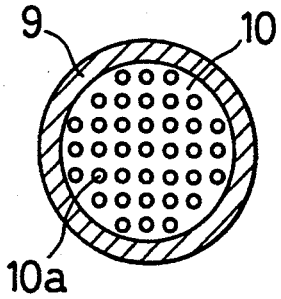
Figure 11:
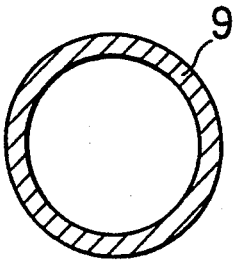
Figure 12:
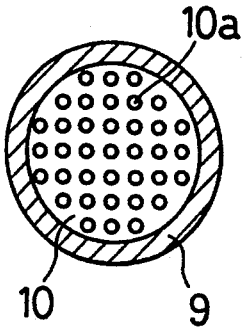
Figure 13:
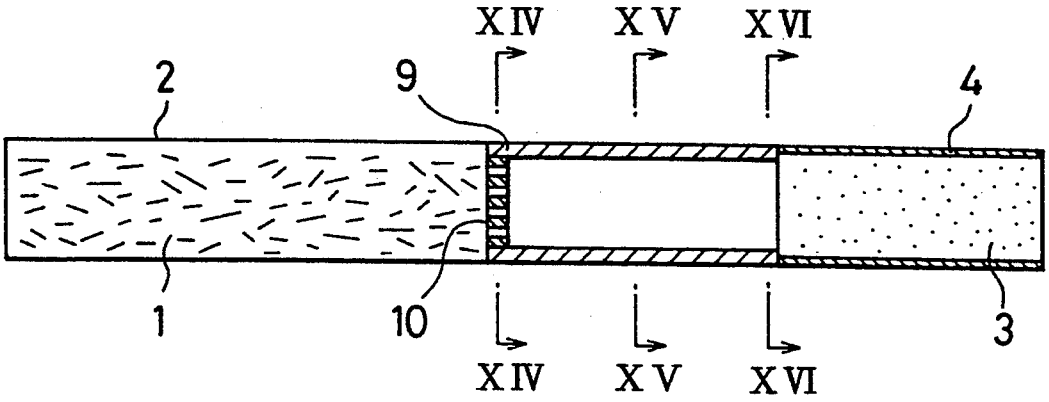
Figure 14:
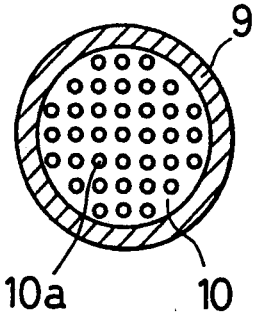
Figure 15:
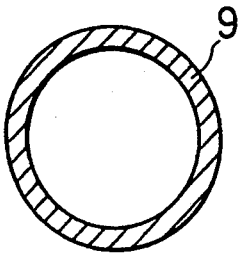
Figure 16:
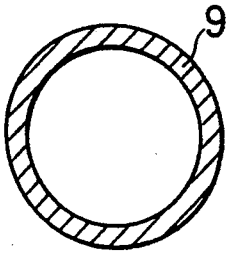

Since the GORE-TEX members 6*a* and 6*b* are gas permeable but not water permeable, the cylindrical member can hold a moistened fibrous material 7 consisting, e.g., of pulp fibers impregnated with water, or contain water 8, as in the case of the second embodiment shown in FIG. 5.

In this cigarette, constructed as described above, the tobacco smoke passes through the GORE-TEX member 6*a* at the front end of the cylindrical member 5 and comes into contact with the moistened fibrous material 7 or the water 8 in the cylindrical member as it flows therethrough before it enters the mouth of the smoker by way of the GORE-TEX member 6*b* and the filter 3. Since the tobacco smoke is thus brought into contact with the moistened fibrous material 7 or the water 8 in the cylindrical member as it flows therethrough, nicotine in the smoke is absorbed by the moistened fibrous material 7 or the water 8, thereby mitigating the harm done to the health of the smoker. Further, if the cigarette is left unextinguished in an ashtray or is carelessly thrown away, it goes out by itself when the the burning tobacco comes into contact with the GORE-TEX member 6*a* to break it open and thus cause the water 8 to flow out or comes into contact with the moistened fibrous material 7, thereby preventing the interior environment of the room from being fouled by the smoke of a smoldering cigarette. In addition, this cigarette has the marked advantage of preventing forest fires, etc. caused by carelessly thrown away unextinguished cigarettes.

The fibrous member 7, impregnated with water, enables the water to be held in a stationary condition and, further, enlarges the contact area between the tobacco smoke and the water, thereby markedly reducing the amount of nicotine inhaled.

FIGS. 9 through 16 show another embodiment of the present invention. In this embodiment, a metal cylinder 9, constituting the extinguishing member, is inserted between the tobacco 1 rolled up in the paper 2 and the filter 3 constituting the mouthpiece, and the front opening or both the front and rear openings of the cylinder are sealed by a metal disc or metal discs 10 having a multitude of pores 10*a*. The metal cylinder 9 may be empty, that is, it contains no tobacco or, in the alternative, may contain the moistened fibrous material 7 or water 8, as described above.

Figure 17:
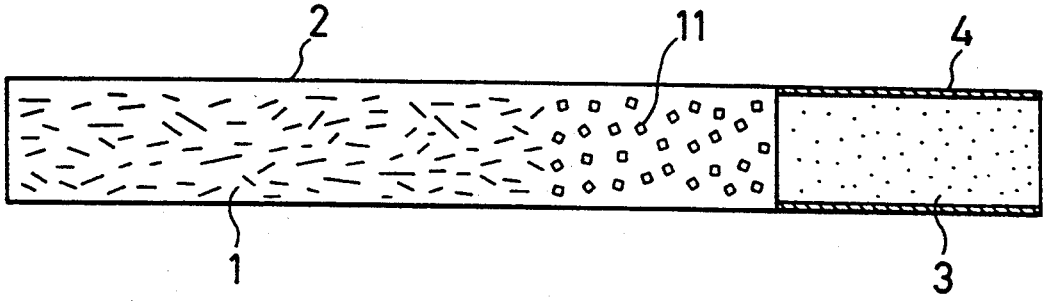
FIG. 17 is a longitudinal sectional view of a fifth embodiment of this invention.

FIG. 17 shows still another embodiment, in which a fire extinguisher agent 11 is mixed with the tobacco in that section of the cigarette which is adjacent to the filter 3 constituting the mouthpiece, thereby forming an extinguishing section.

The present invention is not restricted to the several embodiments thereof described above but instead can be partially modified without departing from the scope of its gist.

As stated above, conventional cigarettes are entirely made of flammable materials, so that, once lighted, they do not go out before they are completely burned up. Thus, they often cause fires. Further, when left unextinguished in ashtrays, they will continue to smolder, thereby deteriorating a residential environment. In contrast, the cigarette of this invention, which is automatically extinguishable, can help to substantially reduce the danger of fires due to unextinguished cigarettes.

In addition to the prevention of deterioration in a residential environment due to unextinguished cigarettes, the cigarette of this invention holding water and equipped with an extinguisher agent has an advantage in that nicotine is absorbed in water, thereby preventing harm from being done to the health of the human body.

Generally speaking, the nearer the portion of a cigarette being burned is to the mouthpiece, the larger the amount of nicotine inhaled. In the cigarette of this invention, the portion containing tobacco is shorter than in ordinary cigarettes, and when that portion has been burned, the cigarette goes out by itself. Thus, compared with conventional cigarettes, the cigarette of this invention is more advantageous from the viewpoint of health, and, further, helps to reduce the amount of tobacco used.

What is claimed is:

1. An automatically extinguishable cigarette comprising: a tobacco section in which tobacco is rolled up; a filter constituting a mouthpiece; a cylindrical member provided between said tobacco section and said filter and formed of a flame-resistant material; sealing members sealing front and rear openings of said cylindrical member and formed of a composite-material consisting of a micro-porous sheet of polytetrafluoroethylene and polyurethane; and extinguishing means consisting of a moistened fibrous material contained in said cylindrical member.

2. An automatically extinguishable cigarette according to claim 1, wherein said cylindrical member is formed of a flame-resistant plastic material.

3. An automatically extinguishable cigarette comprising: a tobacco section in which tobacco is rolled up; a filter constituting a mouthpiece; a cylindrical member provided between said tobacco section and said filter and formed of a flame-resistant material; sealing members sealing front and rear openings of said cylindrical member and formed of a composite-material consisting of a micro-porous sheet of polytetrafluoroethylene and polyurethane; and extinguishing means consisting of water contained in said cylindrical member.

4. An automatically extinguishable cigarette according to claim 3, wherein said cylindrical member is formed of a flame-resistant plastic material.

5. An automatically extinguishable cigarette, comprising:

a tobacco section in which tobacco is rolled up;

a filter comprising a mouth piece;

a cylindrical member disposed between said tobacco section and said filter and formed from a flame-resistant material including at least one of a stainless steel sheet and an aluminum foil, said cylindrical member defining a front opening and a rear opening;

sealing members sealing said front and said rear openings of said cylindrical member, said sealing members formed of a composite-material including a micro-porous sheet of polytetrafluoroethylene and polyurethane; and an extinguishing material comprising a moistened, fibrous material contained in said cylindrical member.

6. An automatically extinguishable cigarette, comprising:

a tobacco section in which tobacco is rolled up;

a filter comprising a mouth piece;

a cylindrical member disposed between said tobacco section and said filter and formed from a flame-resistant material including at least one of a stainless steel sheet and an aluminum foil, said cylindrical member defining a front opening and a rear opening;

sealing members sealing said front and said rear openings of said cylindrical member, said sealing member formed of a composite-material consisting of a micro-porous sheet of polytetraflouroethylene and polyurethane; and an extinguishing material comprising water contained in said cylindrical member.

* * * * *